United States Patent [19]

Delio et al.

[11] Patent Number: 4,559,804

[45] Date of Patent: Dec. 24, 1985

[54] METHOD AND APPARATUS FOR FORGING WEDGE-SHAPED PARTS

[76] Inventors: Ralph D. Delio, 4355 Brendan La., North Olmsted, Ohio 44070; Donald J. Diemer, R.D. #1 Susan Trace, New Wilmington, Pa. 16142

[21] Appl. No.: 500,886

[22] Filed: Jun. 3, 1983

Related U.S. Application Data

[63] Continuation-in-part of Ser. No. 297,741, Aug. 31, 1981, Pat. No. 4,425,779, which is a continuation-in-part of Ser. No. 2,851, Jan. 12, 1979, Pat. No. 4,294,101.

[51] Int. Cl.[4] ..... B21D 22/00

[52] U.S. Cl. ..... 72/356; 72/357; 72/358; 72/472; 72/404; 29/148.3

[58] Field of Search ..... 72/356, 357, 358, 359, 72/360, 472, 455, 404; 29/148.3

[56] References Cited

U.S. PATENT DOCUMENTS

| | | | |
|---|---|---|---|
| 172,258 | 1/1876 | Chapman | 72/472 |
| 189,232 | 4/1877 | Rieckel | 72/472 |
| 1,678,451 | 6/1928 | Taylor | 72/356 |
| 2,344,803 | 3/1944 | Criley | 72/356 |
| 4,094,183 | 6/1978 | Mettler | 72/356 |
| 4,294,101 | 10/1981 | Diemer et al. | 72/356 |
| 4,304,115 | 12/1981 | Martin | 72/359 |
| 4,321,818 | 3/1982 | Bessho | 72/360 |
| 4,382,324 | 5/1983 | Halene | 72/356 |
| 4,413,496 | 11/1983 | Diemer et al. | 72/356 |

FOREIGN PATENT DOCUMENTS

| | | | |
|---|---|---|---|
| 338344 | 6/1959 | Switzerland | 72/357 |

*Primary Examiner*—Daniel C. Crane
*Assistant Examiner*—David B. Jones
*Attorney, Agent, or Firm*—Fay, Sharpe, Fagan, Minnich & McKee

[57] ABSTRACT

A rectangular prism (FIG. 10A) is cut diagonally to form a pair of generally wedge-shaped billets (FIG. 10B). The generally wedge-shaped billets are heated and placed in a transversely elongated die cavity of a lower busting die (20). An upper busting die (22) presses the billet generally into conformity with the busting die cavity. The busting dies include a projection (36) which forms a recess in one planar surface of the billet (FIG. 10C). The busted billet is disposed axially in an axially elongated split ring die cavity (46) of a split ring die (40). A blocking punch (60) presses the billet generally into conformity with the split ring die cavity (FIG. 10D). The split ring die and the blocked billet are moved from a blocking well (14) to a finishing well (16) where a finishing punch (70) presses the blocked billet into conformity with the finishing die cavity (FIG. 10E). The flanges are trimmed from the finished billet and mounting apertures (80, 82) are punched to form an excavator tip (FIG. 10F).

12 Claims, 15 Drawing Figures

METHOD AND APPARATUS FOR FORGING WEDGE-SHAPED PARTS

BACKGROUND OF THE INVENTION

This application is a continuation-in-part of earlier filed application Ser. No. 297,741, filed Aug. 31, 1981, now U.S. Pat. No. 4,425,779, which in turn is a continuation-in-part of earlier filed application Ser. No. 2,851, filed Jan. 12, 1979, now U.S. Pat. No. 4,294,101.

The present invention relates to a method and apparatus for forming metal parts. The invention finds particular application in forging ground engaging excavator tips and will be described with particular reference thereto. It is to be appreciated, however, that the invention has broader applications in forming other generally wedge-shaped metal parts, symmetric and non-symmetric parts of various shapes, and the like.

Heretofore, excavator tips were forged with a multistep forging operation. A heated, elongated rectangular or cylindrical billet was forged into a generally wedge-shaped form. More specifically, the billet was pressed one or more times in a forging press to narrow one end by forcing material into a flange. The flange was trimmed forming a generally wedge-shaped billet or blank. The wedge-shaped blank was positioned horizontally in a die cavity defining the shape of the finished product. A heading tool repeatedly impacted the wider end of the wedge-shaped blank axially in a multiple-blow upsetting process. The repeated horizontal impacting formed a mounting cavity in the wide end of the blank while forcing the blank into conformity with the die cavity. The blank was removed from the die cavity and the flashing trimmed.

Frequently, it was necessary to reheat the blank between the first flashing trimming operation and the upsetting process. Reheating was particularly necessary with larger excavator tips. Another problem with the prior art manufacturing technique was that the multiple-blow forming operations were relatively slow and time consuming.

Others have cast excavator tips. However, heating steel temperatures is highly energy consumptive and expensive. Shrinkage during cooling renders tolerances difficult to maintain. Further, the metal hardening inherent in forging operations is absent in the softer cast parts.

The present invention contemplates manufacturing excavator tips with a closed-die forging apparatus and method which overcomes the above-referenced drawbacks and others.

SUMMARY OF THE INVENTION

In accordance with the present invention, there is provided a closed die forging apparatus for forming elongated generally wedge-shaped parts. The apparatus includes a lower die holder assembly having at least a busting well and a finishing well. A lower busting die with a transversely elongated die cavity is mounted in the busting well. A split ring die having an axially elongated die cavity is selectively received in the finishing well. An upper die assembly includes an upper busting die and a finishing punch. The upper busting die coacts with the lower busting die to preform a billet. The finishing punch is disposed opposite the finishing well for displacing a preformed billet into conformity with the split ring die cavity. In the preferred embodiment, the lower die holder further includes a blocking well for selectively receiving the split ring die and the upper die assembly further includes a blocking punch.

In accordance with another aspect of the invention, there is provided a method of closed die forging elongated, generally wedge-shaped parts. A generally wedge-shaped blank is placed generally transversely in a transversely elongated lower busting die cavity. An upper busting die is pressed against the billet to preform it. The preformed blank is disposed axially in an axially elongated die cavity of a split ring die. A finishing punch is pressed axially into the split ring die cavity to displace the preformed billet into conformity with the split ring die cavity. In the preferred embodiment, a rectangular or cylindrical billet is cut diagonally to prepare two generally wedge-shaped blanks for the busting step.

A primary advantage of the present invention is that it maintains close tolerances while forming elongated or non-symmetric parts.

Another advantage of the present invention is that the parts are formed quickly, with relatively little labor, and machine time.

Still further advantages of the present invention will become apparent upon reading and understanding the following detailed description.

BRIEF DESCRIPTION OF THE DRAWINGS

The invention may take form in various parts and arrangements of parts or various steps and arrangements of steps. The drawings are only for the purpose of illustrating a preferred embodiment of the invention and are not to be construed as limiting it.

DETAILED DESCRIPTION OF THE PREFERRED EMBODIMENT

Figure 1:
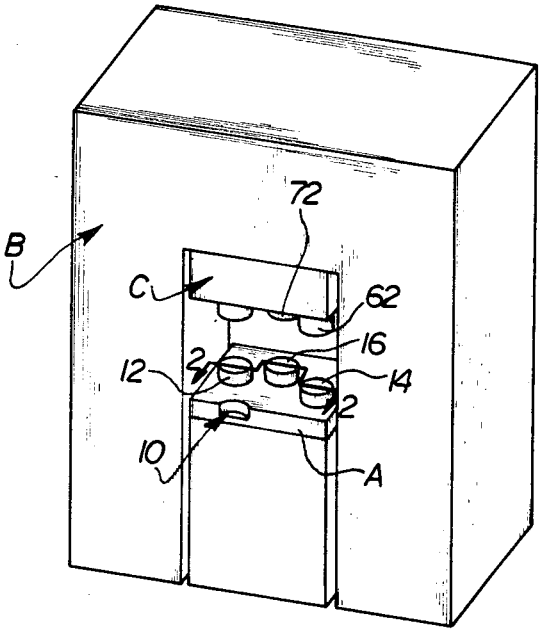
FIG. 1 is a perspective view of a forging assembly in accordance with the present invention.

With particular reference to FIG. 1, a die block or holder A is supported by a stationary lower foundation or die set. A mechanical press B selectively moves an upper die assembly C relative to the die block to press a heated billet therebetween. The die block defines a series of wells for descaling, busting, blocking, and finishing the billet. Optionally, mechanical manipulating means or robots, not shown, may be provided for cyclically positioning and moving heated billets among dies disposed in the die block wells.

Figure 10A:
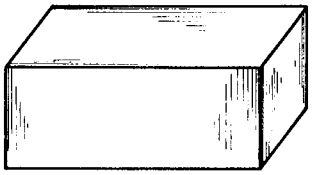
FIGS. 10A–F are perspective views of the billet at various stages during its transformation into an excavator tip in accordance with the present invention.
Figure 10B:
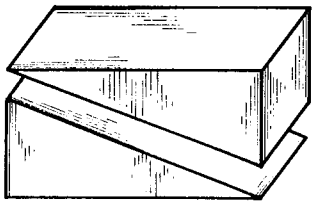

A rectangular parallelepiped billet, note FIG. 10A, is cut diagonally to form a pair of generally wedge-shaped billets or blanks, note FIG. 10B. The wedge-shaped billets are heated in a furnace in preparation for the forging operation. Optionally, other techniques may be utilized to prepare generally wedge-shaped billets.

Figure 4:
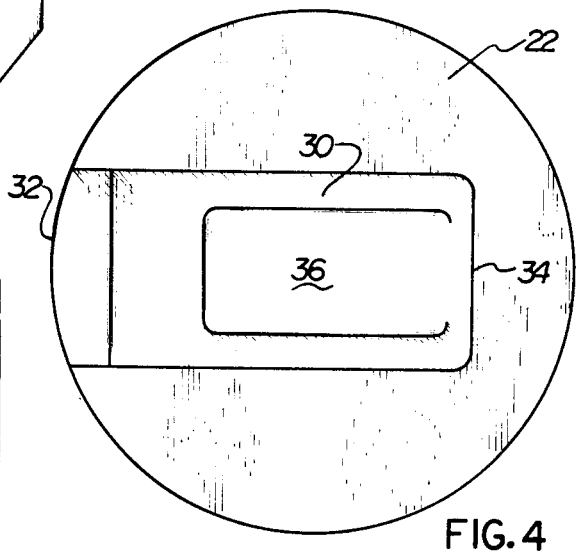
FIG. 4 is a top view of the upper busting die of FIG. 3.
Figure 3:
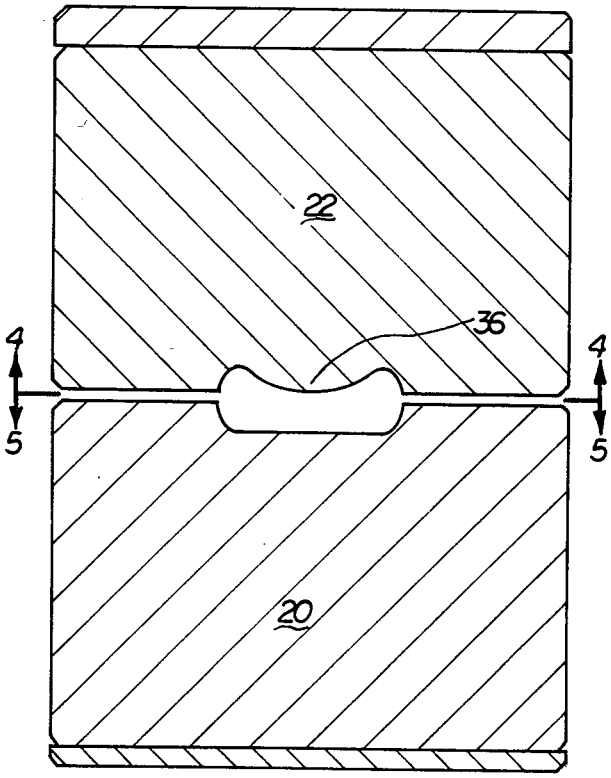
FIG. 3 is a sectional view through section 3—3 of the busting die of FIG. 2.
Figure 5:
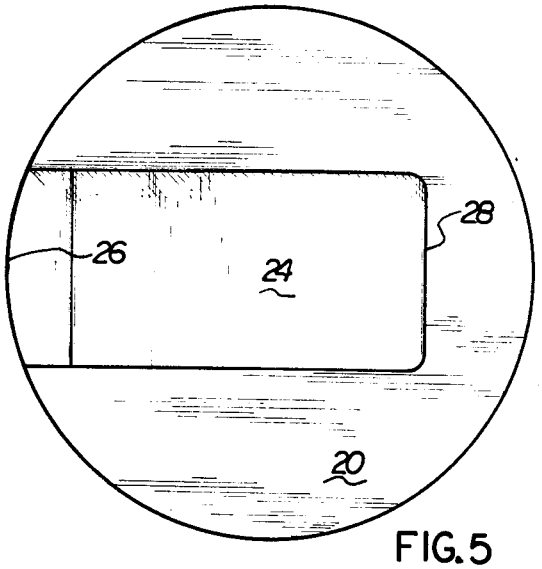
FIG. 5 is a top view of the lower busting die of FIG. 3.
Figure 2:
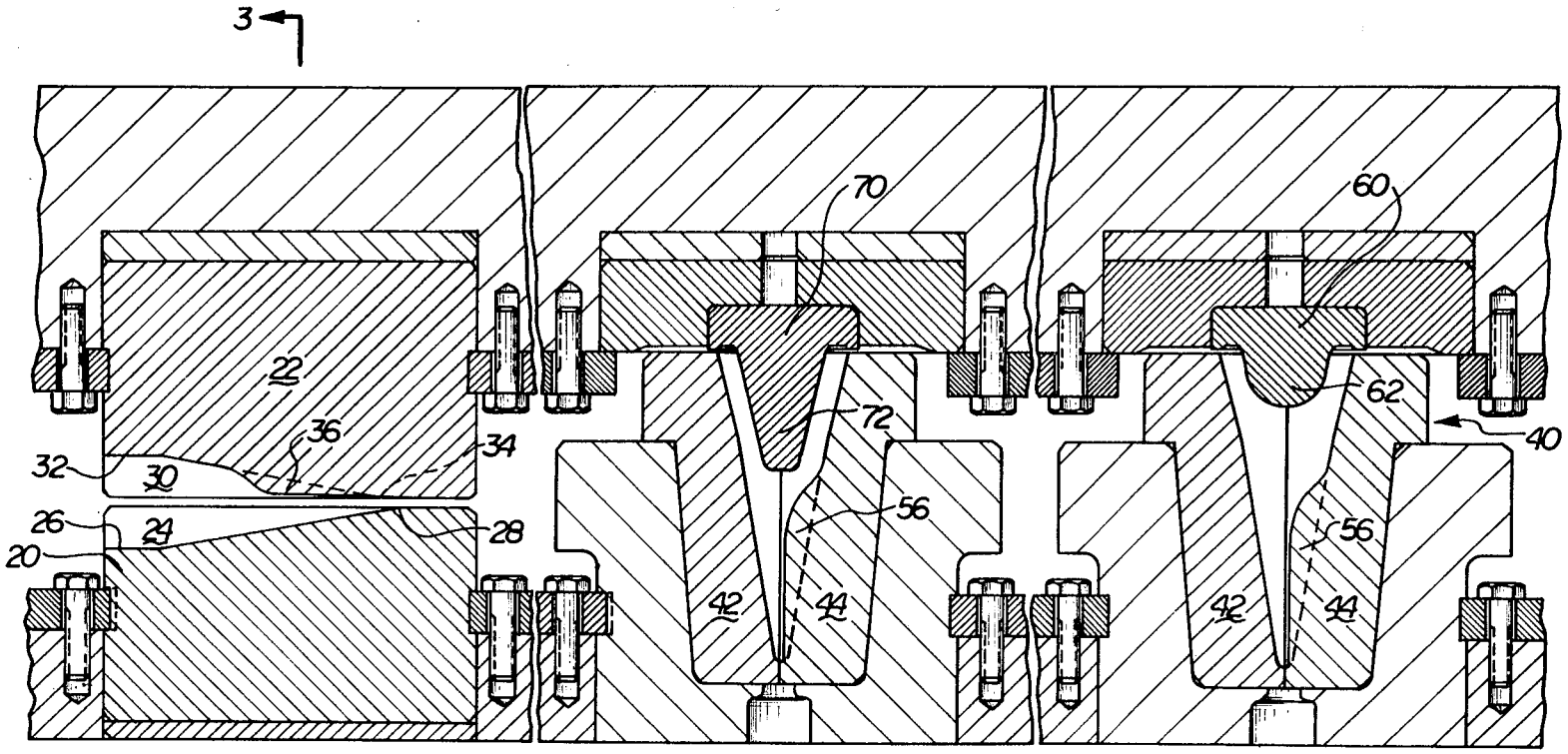
FIG. 2 is a side sectional view through section 2—2 of FIG. 1.
Figure 6:
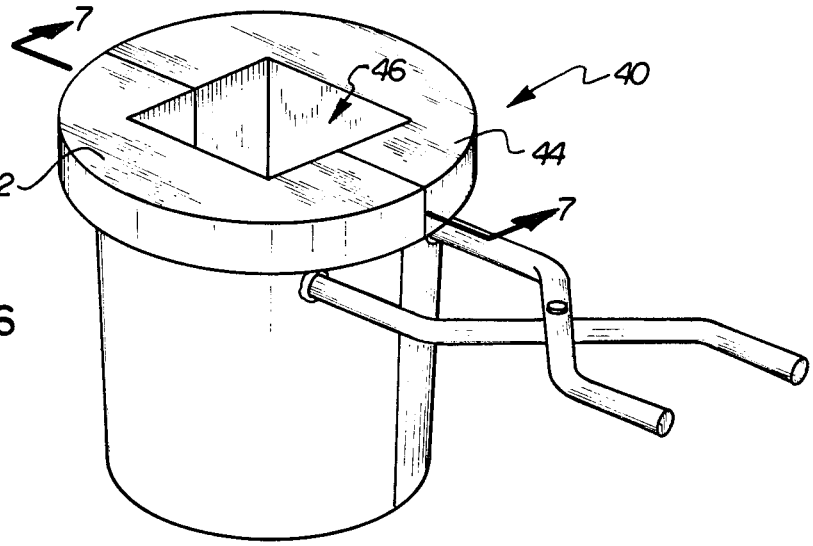
FIG. 6 is a perspective view of the split ring die of FIG. 2.
Figure 7:
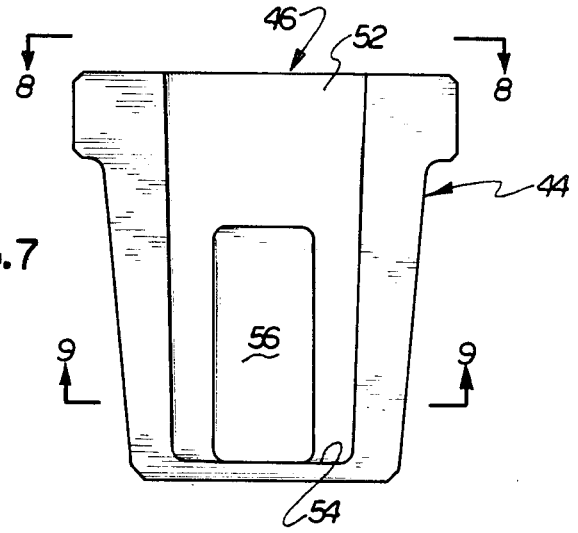
FIG. 7 is a sectional view through section 7—7 of FIG. 6.
Figure 8:
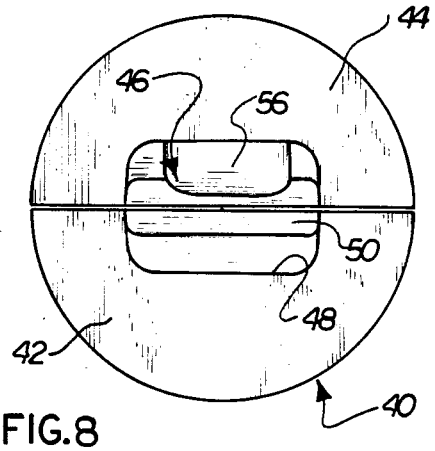
FIG. 8 is a top view of the split ring die of FIG. 6.
Figure 9:
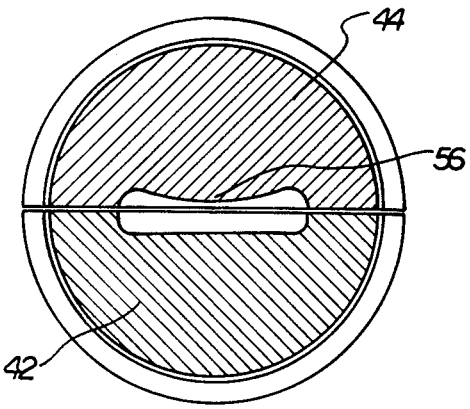
FIG. 9 is a sectional view through section 9—9 of FIG. 7.
Figure 10C:
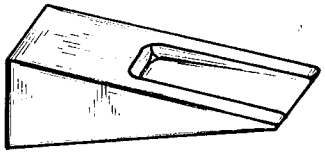
Figure 10D:
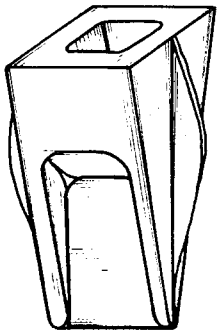

With continuing reference to FIG. 1, the die block A defines a shallow descaling well 10 in which the wedge-shaped billets are placed to be impacted and descaled. A busting well 12 receives a lower busting die which is described in greater detail in conjunction with FIGS. 2, 3 and 5. The upper die assembly, analogously, carries an upper busting die which is described in greater detail in conjunction with FIGS. 2, 3, and 4. After the generally wedge-shaped billet is busted in the busting die, the busted billet, note FIG. 10C, is positioned in a split ring die which is described in conjunction with FIGS. 6–9. The split ring die including the received billet is positioned in a blocking well 14 in which the billet is blocked into partial conformity with the split ring die by a blocking punch described in greater detail in conjunction with FIG. 2. Subsequent to the blocking operation, the split ring die and blocked billet, note FIG. 10D, are disposed in a finishing well 16. In the finishing well, the billet is pressed into full conformity with the split ring die by a finishing punch, described in greater detail in conjunction with FIG. 2. After the finishing operation, flashings are trimmed from the finished billet, note FIG. 10E, using conventional finishing techniques. The trimmed billet is punched with holes to receive a mounting pin, thus producing the excavator tip, note FIG. 10F.

With particular reference to FIGS. 2–5, a lower busting die 20 is mounted in the busting well 12 and an upper busting 22 is mounted in a mating relationship on the upper die assembly C. The busting die impacts the blank to change it from the configuration of FIG. 10B to the configuration of FIG. 10C. The lower busting die defines a transverse cavity 24 which has a generally rectangular horizontal cross section. More specifically, the lower busting die cavity is relatively deep at a peripheral end 26 and its lowermost surface tapers to a linear edge at an interior end 28. In this manner, the lower busting die 20 defines a generally wedge-shaped cavity therein. The upper busting die 22 defines an analogous cavity 30. The upper busting die cavity is again relatively deep adjacent a peripheral end 32 and its lowermost surface tapers to a linear edge adjacent an interior end 34. Intermediate its two ends, the upper busting die defines a projection 36 which projects into the upper busting die cavity 30 toward the lower busting die. The upper busting die projection 36 is generally arcuate along its minor axis, note FIG. 3. Along its major axis, the projection extends substantially to the parting line of the upper and lower busting dies. About mid-way between the peripheral and interior ends of the upper die cavity, the projection arcuately tapers generally into conformity with the innermost surface of the upper die cavity.

With particular reference to FIGS. 2, 6, 7, 8, and 9, the busted blank, as illustrated in FIG. 10C, is moved from the busting dies to a split ring die 40. The split ring die includes die halves 42 and 44 which define a die cavity 46 axially therein. The first die half 42 defines a portion of the die cavity which is relatively wide at a top end 48 and its side surface tapers to a linear edge at an interior end 50. The second die half 44 likewise defines a portion of the die cavity which is relatively wide adjacent a top end 52 and its side surface tapers substantially to a linear edge at an inner end 54. A projection 56 projects outward from the second split ring die half side wall adjacent the inner end 54 of the cavity. The projection 56 is smaller than the projection 36 of the busting die such that the busted billet fits readily within the split ring die. That is, the busting die forms an indentation in the billet which is larger than the indentation of the final product. Then during the blocking and finishing operations, the size of the depression is decreased.

A blocking punch 60 includes a relatively small dimple projection 62 which forces the billet generally into conformity with the split ring die. Under the influence of the blocking punch, small side flashings form between the halves of the split ring die which, if one were to remove the billet from the split ring die, would have a configuration generally as shown in FIG. 10D.

Figure 10E:
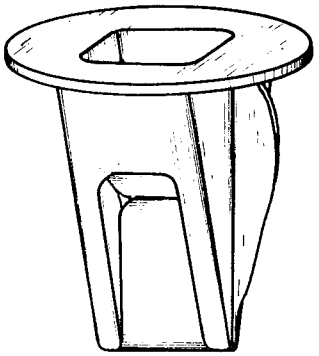

The finishing well 16 is a few thousandths of an inch larger than the blocking well 14 to insure that the split ring die holding the blocked billet fits readily therein. A finishing punch 70 has an enlarged projection 72 which is dimensioned in conformity with a mounting on which the completed excavator tip is to be mounted. During the finishing operation, the billet is forced into full conformity with the split ring die and excess metal flows between the finishing punch and split ring die forming a peripheral flashing. Further, the slight increase in finishing well diameter over the blocking well diameter allows the side flashings to enlarge. As the billet is removed from the split ring die, its configuration is generally as illustrated in FIG. 10E.

Figure 10F:
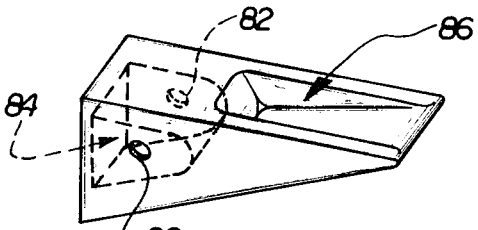

The flashings are trimmed from the excavator tip with conventional trimming operations. With reference to FIG. 10F, mounting apertures 80 and 82 are punched into the side of a mounting well 84 for receiving a mounting pin. A scooping recess 86 is disposed adjacent the forward edge.

It is to be appreciated, of course, that excavator tips of various constructions are utilized when excavating in different soil and rock conditions. This application describes the invention in conjunction with a common excavator tip design. It is to be appreciated that the present invention is equally applicable to other styles of excavator tips, as well as other similarly shaped articles. Split ring dies having cavities of other lengths, widths, and shapes can be readily fashioned to construct these other excavator tip styles and articles.

The invention has been described with reference to the preferred embodiment. Obviously, modifications and alterations will occur to others upon reading and understanding the preceding detailed description of the preferred embodiment. It is intended that the invention be construed as including all such alterations and modifications insofar as they come within the scope of appended claims or the equivalents thereof.

Having thus described a preferred embodiment of the invention, the invention is now claimed to be:

1. A closed die forging apparatus for forming elongated parts, the apparatus comprising:

(a) a lower die holder which defines:

(i) a busting well having a central axis extending in a first direction; and, (ii) a finishing well having a central axis extending substantially parallel to the busting well central axis;

(b) a lower die assembly including:

(i) a lower busting die defining a transverse elongated busting die cavity extending transverse to the busting well central axis, the lower busting die being disposed in the busting well; and, (ii) a split ring die removably disposed in the finishing well which split ring die defines an axially elongated die cavity therein extending generally along the finishing well central axis, the split ring die cavity having a relatively wide end and a relatively narrow end and having a projection generally transverse to the finishing well central axis for defining a recess in an elongated surface in a forged part; and, (c) an upper die assembly which includes:

(i) an upper busting die for mating with the lower busting die cavity to coact therewith to preform a billet received therein; and, (ii) a finishing punch disposed opposite the finishing well for selectively entering the split ring die cavity wide end and displacing the preformed billet into conformity with the split ring die cavity.

2. The apparatus as set forth in claim 1 wherein the lower die holder further includes a blocking well for selectively receiving the split ring die therein and wherein the upper die assembly further includes a blocking punch disposed opposite the blocking well for displacing the preformed billet into general conformity with the split ring die cavity.

3. A closed die forging apparatus for forming elongated, wedge-shaped parts, the apparatus comprising:

an upper die assembly and a lower die assembly which are movable vertically relative to each other;

an upper and lower die assemblies including an upper busting die and a lower busting die which define a horizontally elongated wedge-shaped die cavity therebetween and which coact to preform a billet received therein, one of the busting dies having a projection which defines a recess in an elongated surface of the billet being busted;

the lower die assembly further including a split ring die which defines a generally wedge-shaped die cavity which extends vertically and along a central vertical axis of the split ring die, the wedge-shaped die cavity having a relatively narrow edge away from the upper die assembly and a relatively wide end toward the upper die assembly; and, the upper die assembly further including a finishing punch disposed in alignment with the split ring die central axis for displacing the preformed billet into conformity with the split ring die cavity.

4. The apparatus as set forth in claim 3 wherein the split ring die includes two split ring die halves, one of the split ring die halves having a projection for finishing the billet recess.

5. The apparatus as set forth in claim 4 wherein the busting die projection is larger than the split ring die projection to facilitate disposing the busted billet in the split ring die.

6. A method of closed die forming excavator tips, the method comprising:

forming generally wedge-shaped billets, each having at least a length;

placing one of the wedge-shaped billets in a lower busting die with the billet length disposed transverse to an axis of the lower busting die;

moving an upper busting die generally parallel to the lower busting die axis to press against the billet to preform the wedge-shaped billet generally into conformity with a busting die cavity defined between the upper and lower busting dies;

in a finishing die cavity defined between a pair of split ring die halves which finishing die cavity is elongated along a finishing die axis that is disposed parallel to the busting die axis, disposing the preformed billet with the billet length extending generally along the finishing die axis, the finishing die cavity including a relatively narrow end which receives a narrow end of the preformed billet and a relatively wide end which receives a wide end of the preformed billet; and, pressing a finishing punch into the finishing die cavity wide end displacing the preformed billet into conformity with the finishing die cavity.

7. The method as set forth in claim 6 wherein in the step of pressing the wedge-shaped billet between busting dies further includes forming a recess in a planar surface of a billet and wherein the finishing die cavity has a projection projecting therein which is received in the busting die formed recess.

8. The method as set forth in claim 7 wherein the billet recess is larger than the split ring die projection such that the billet is readily received within the finishing die cavity.

9. The method as set forth in claim 7 further including the step of pressing a blocking punch which is smaller than the finishing punch axially into the finishing die cavity wide end displacing the preformed billet into generally conformity with the finishing die cavity prior to pressing the finishing punch into the finishing die cavity.

10. The method as set forth in claim 7 wherein the step of forming generally wedge-shaped billets includes cutting billets generally in the shape of rectangular parallelepiped diagonally such that each rectangular parallelepiped billet forms a pair of generally wedge-shaped billets.

11. The method as set forth in claim 7 wherein pressing the finishing punch into the die cavity displaces a portion of the billet between the split ring die halves forming side flashing and between the split ring die and finishing punch forming a peripheral flange and further including the step of trimming the side and peripheral flashings.

12. A method of closed die forging non-symetric parts, the method comprising:

cutting a generally rectangular parallelepiped billet diagonally to form a pair of generally wedge-shaped billets, each billet having a length extending along a major dimension thereof;

heating the wedge-shaped billets;

disposing the wedge-shaped billet in a lower busting die cavity which is elongated generally transverse to a first direction, the wedge-shaped billet length extending along the elongated lower busting die cavity transverse to the first direction;

pressing an upper busting die against the billet to preform the billet;

in a split ring die which defines an elongated die cavity extending parallel to the first direction, disposing the preformed billet with the billet length extending generally parallel to the first direction;

pressing a blocking punch generally parallel to the first direction into general conformity with the split ring die cavity; and, pressing a finishing punch into the split ring die cavity to displace the billet into conformity with the split ring die cavity.

* * * * *